US008240773B2

(12) United States Patent
Hargrave et al.

(10) Patent No.: US 8,240,773 B2
(45) Date of Patent: Aug. 14, 2012

(54) METHOD AND APPARATUS FOR MONITORING GATEROAD STRUCTURAL CHANGE

(75) Inventors: Chad Owen Hargrave, Gaythorne (AU); Jonathon Carey Ralston, Gaythorne (AU); Michael Shawn Kelly, Pullenvale (AU)

(73) Assignee: Commonwealth Scientific and Industrial Research Organisation, Campbell, ACT (AU)

( * ) Notice: Subject to any disclaimer, the term of this patent is extended or adjusted under 35 U.S.C. 154(b) by 941 days.

(21) Appl. No.: 11/995,778

(22) PCT Filed: Jul. 15, 2005 (Under 37 CFR 1.47)

(86) PCT No.: PCT/AU2005/001039

§ 371 (c)(1), (2), (4) Date: Nov. 7, 2008

(87) PCT Pub. No.: WO2007/009149

PCT Pub. Date: Jan. 25, 2007

(65) Prior Publication Data

US 2009/0134692 A1 May 28, 2009

(51) Int. Cl.
*E21D 23/12* (2006.01)

(52) U.S. Cl. ..... 299/1.3; 299/11; 299/12

(58) Field of Classification Search ..... 299/1.3, 299/11, 12, 15, 19, 95, 1.05; 702/11
See application file for complete search history.

(56) References Cited

U.S. PATENT DOCUMENTS

| | | | | |
|---|---|---|---|---|
| 3,371,964 | A * | 3/1968 | Weber | 299/1.1 |
| 4,179,216 | A * | 12/1979 | Theurer et al. | 356/4.01 |
| 4,884,847 | A * | 12/1989 | Bessinger et al. | 299/1.05 |
| 2003/0052529 | A1 * | 3/2003 | Hakkinen | 299/1.05 |

FOREIGN PATENT DOCUMENTS

| | | |
|---|---|---|
| DE | 30 43 510 | 6/1982 |
| DE | 43 02 098 | 8/1994 |
| JP | 2889557 | 2/1999 |

* cited by examiner

*Primary Examiner* — Shane Bomar
*Assistant Examiner* — Yong-Suk Ro
(74) *Attorney, Agent, or Firm* — Merchant & Gould P.C.

(57) ABSTRACT

A method and apparatus is provided for determining structural change in a mining operation. A first scan of gateroad surfaces is obtained and information of the scan profile is stored. At a later time a second scan of the gateroad surfaces is then obtained. Information of the scans can be registered and any difference noted. If the difference exceeds a threshold a warning can be provided indicating a gateroad structural change that may be hazardous. The scans can be made from a single sensor, or from multiple sensors (301, 303). In the case where the sensors (301, 303) are mounted on a gateroad traversing structure (109), the distance of spacing of the sensors (301, 303) can be used to determine when the sensor (303) has reached a position of movement or travel of the gateroad traversing structure (109) where the scan from sensor (301) was made. A distance sensor (309) can be provided to determine the distance of movement and where the scans coincide.

19 Claims, 6 Drawing Sheets

METHOD AND APPARATUS FOR MONITORING GATEROAD STRUCTURAL CHANGE

FIELD OF THE INVENTION

This invention relates to a method and apparatus for monitoring gateroad structural change in a mining operation and relates particularly but not exclusively to use in longwall mining processes such as those used for coal extraction.

BACKGROUND

Longwall mining is one of the most efficient methods for underground coal recovery where a large panel of coal, bounded by roadways (gateroads) is extracted by means of a mechanised shearing apparatus. The gateroads provide access for equipment and personnel and are essential to the longwall mining process.

The normal process of longwall mining involves removing product from the face of a product panel while progressively retreating in the direction of a gateroad. Thus, as the mining progresses, a mining machine installation moves down a gateroad and carries with it a shearing apparatus that shears product from the product panel. The movement into the product panel in the direction of the gateroad is termed "retreat".

The gateroads are usually cut into the strata before mining of the product from the product panel and product seam, and the gateroads are intended to have long term structural integrity. The process of removing the product from the product panel can, however, introduce large stresses in regions surrounding the gateways. These stresses, in turn, may produce local movements to the surfaces of the gateroads such as fracturing, guttering, spalling, and cracking which are usually readily detected by the naked eye and can be suitably addressed. The stresses, however, produce other local features in the gateroads which can lead to deformation of the overall gateroad structure over time. This deformation is known as convergence. Convergence represents a subtle and dangerous form of stress-induced gateroad deformation because it usually occurs at a rate which is imperceptible to the unaided human eye and this makes it difficult to detect. Failure to note gateroad convergence can lead to collapse and failure of the gateroads themselves and can result in severe safety hazards to personnel and equipment.

Convergence has been determined in the past by use of an extensometer device which is placed at specific points in the gateroad to measure the distance between the gateroad roof and the gateroad floor at different time instants. The method is dependent on manual operation of the extensometer device and is invasive, and often is required to be performed in a hazard area. It is not until after the manual measurement is made with the extensometer device that the human operator can ascertain that there has been excessive convergence resulting in a hazardous situation. Further, such methods can be obstructive to the normal passage of the gateroad traversing structure of a mining machine installation used for mining product from the product face.

Objects and Statement of Invention

It is therefore an object of the present invention to attempt to provide a method and apparatus for monitoring gateroad structural change that overcomes one or more of the aforementioned problems.

According to a first broad aspect of the invention there is provided a method of determining gateroad structural change in a mining operation comprising:

using a gateroad profile scanning sensor at a position of a gateroad to scan generally orthogonally to a direction of the gateroad and obtaining a first profile scan of surfaces of the gateroad and storing information of that first profile scan in a memory, at a later time obtaining a second profile scan of surfaces of the gateroad generally orthogonal to the direction of the gateroad at a position in the gateroad that generally coincides with the position where the first profile scan was made, and obtaining information of that second scan, registering the stored information of the first profile scan with information of the second profile scan, noting from the registered information of the first profile scan and the second profile scan any structural change of the surfaces of the gateroad.

According to a second broad aspect of the invention there is provided an apparatus for determining gateroad structural change in a mining operation comprising scanning apparatus for providing information of a first profile scan of surfaces of a gateroad at a position of a gateroad and generally orthogonal to a direction of the gateroad, and at a later time information of a second profile scan of surfaces of a gateroad generally at the same position of the gateroad as the first scan and generally orthogonal to a direction of the gateroad, a memory store for storing information of a first profile scan, a registering means for registering the profile scan information stored in the memory store with information of the second profile scan position where the second scan coincides with the position where the first scan was made, a scan difference processor to permit noting of differences in information of first scan and the second scan, whereby a gateroad structural change can be determined

BRIEF DESCRIPTION OF THE DRAWINGS

In order that the invention can be more clearly ascertained examples of embodiments of the invention will now be described with reference to the accompanying drawings wherein.

DETAILED DESCRIPTION OF PREFERRED EMBODIMENTS

Figure 1:
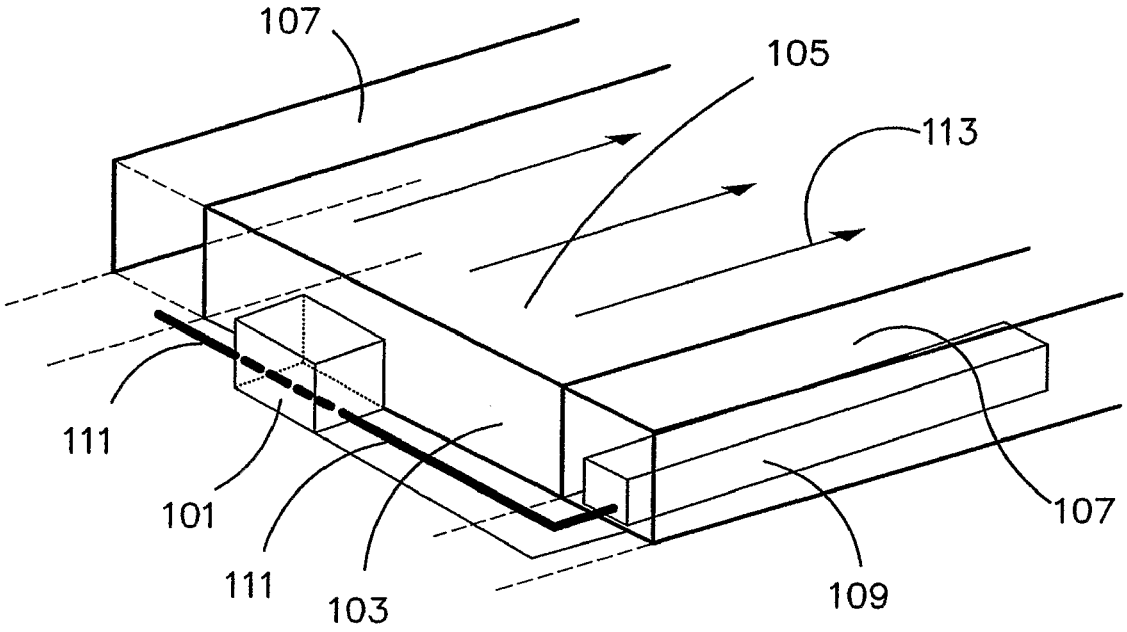
FIG. 1 is a diagrammatic view showing a 3D cut-away of a longwall underground coal mining operation (not to scale)

FIG. 1 is a diagrammatic view showing a 3D cut-away of a longwall underground coal mining operation (not to scale). Here, there is a provided a longwall shearer 101 that traverses from side to side across a coal panel 103 in a coal seam 105. At each side of the coal seam 105 there are provided rectangular shaped roadways known as gateroads 107. The gateroads 107 are cut into the strata and/or the coal seam 105 so that the direction and size of the gateroads 107 conforms to accurate parameters such as size and 3D positioning and direction. Typically, the gateroads 107 run parallel to one another. A gateroad traversing structure 109 is provided in one or both of the gateroads 107. Mechanical linkage 111 connects the gateroad traversing structure 109 and the shearer 101. Typically, the mechanical linkage 111 is a rail track means on which the shearer 101 can traverse.

The gateroad traversing structures 109 form part of the mining machine installation associated with mining, and the gateroad traversing structures 109 assume a particular position of retreat in the gateroads 107 during mining. The shearer 101 traverses backwards and forwards along the rail track means forming the mechanical linkage 111. As the shearer 101 moves, coal is removed from the coal panel 103. After the shearer 101 has traversed from one side to the other side of the coal panel 103, the gateroad traversing structures 109 are caused to retreat in the direction of the arrows 113, thereby bringing the shearer 101 into a position to mine further coal from a fresh face of the coal panel 103. The above process is repeated, advancing the face, until the coal seam 105 is removed.

Longwall mining apparatus of the above type is well known.

Figure 2:
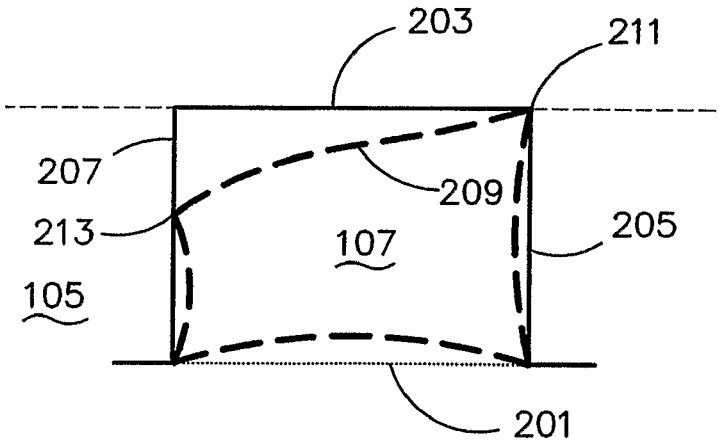
FIG. 2 is a vertical cross sectional view through a gateroad showing structural change over time of the profile of the gateroad walls and/or roof.

FIG. 2 shows a vertical cross sectional view through a gateroad 107. Here, the gateroad 107 has a floor 201, a roof 203, and two upright sidewalls 205 and 207. Sidewall 207 is directly adjacent the coal seam 105 whereas upright sidewall 205 is adjacent the surrounding strata and is distant from the coal panel 103 that is to be mined. For illustration, the dotted line 209 shows exaggerated convergence behaviour that has occurred in the gateroad 107. This convergence behaviour represents a structural change in the gateroad 107 during a mining operation. Here, it can be seen that the uppermost corner 211 has maintained general integrity and has not been subjected to excessive structural change. This is because that upper corner 211 is remote or distant from the mined coal panel 103. Thus, the corner 211 is generally supported by the surrounding strata. On the other hand, the coal panel side corner 213 is shown considerably deformed. This structural change has occurred by reason of removing the coal panel 103 from the adjacent upright sidewall 207. The dotted line 209 shows deformation of the sidewalls 205 and 207 and a general change of shape of the roof 209. The floor 201 may also change, but generally to a lesser extent than the sidewall 207 and roof 203. Thus it can be seen from FIG. 2 that the profile of the gateroad 107 roof and sidewall surfaces has changed: this change may present a hazardous situation for personnel and/or mining equipment. A convergence as shown in FIG. 2 could be indicative of an impending collapse of the gateroads 107, and/or of collapse of strata into the mined goaf. This convergence is therefore a structural change of the surfaces of the gateroad 107.

Figure 3:
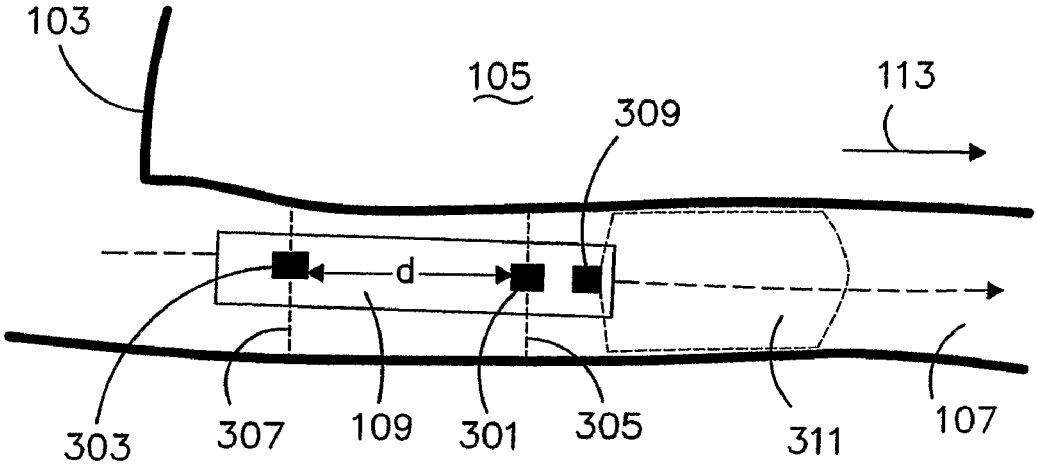
FIG. 3 is a plan view of a longwall gateroad.

FIG. 3 is a plan view of one longwall gateroad 107 alongside a coal seam 105 showing the position of a gateroad traversing structure 109. The mechanical linkage 111 shown in FIG. 1 has been omitted in order to aid clarity. FIG. 3 shows a direction of travel known as retreat 113. FIG. 3 also shows that the gateroad traversing structure 109 is within the gateroad 107 relative to the coal panel 103. The gateroad traversing structure 109 may be moved in the travel/retreat direction 113 by known methods and in response to operation of the shearer 101 completing shearing of a coal panel 103.

The gateroad traversing structure 109 has a gateroad profile scanning sensor 301 at a leading position on the gateroad traversing structure 109. There is a second gateroad profile scanning sensor 303 at a trailing position of the gateroad traversing structure. FIG. 3 shows the use of two gateroad profile scanning sensors 301 and 303 to provide a leading scan and trailing scan. The preferred embodiment does not require the installation of surveyed track or specialised rail structures in the gateroad 107 to allow the measurement of gateroad profiles. Instead the gateroad profile sensors 301, 303 are directly mounted on the gateroad traversing structure 109 which is already present in the gateroad 107 as part of the mining process, representing an important practical advantage in terms of simplicity of system implementation. However, in some embodiments, it may be desirable to have a single common gateroad profile scanning sensor that can be moved, for example, on a rotating platen to assume a leading position and a trailing position relative to the gateroad traversing structure 109, thereby using a single sensor for both a leading scan and a trailing scan. In this particular embodiment, there are two separate gateroad profile scanning sensors 301, 303 for obtaining a leading profile scan, and a trailing profile scan respectively. The gateroad profile scanning sensors 301, 303 are separated by a distance "d". Each of the gateroad profile scanning sensors 301, 303 is arranged to scan generally orthogonally to the direction of travel to obtain profile scans of one or more of the gateroad roof, wall and floor surfaces. This is indicated in FIG. 3 by the scan lines 305 and 307 respectively. The gateroad profile scanning sensors 301, 303 are typically scanning sensors of the 2D or 3D range sensors types. These include laser and radar sensors and may include combined range and subsurface feature detection (ground penetrating radar), and/or image sensors such as human visible spectrum cameras or thermal infrared cameras. Further, whilst a single gateroad profile scanning sensor 301, 303 has been shown at each of the leading and trailing positions 305, 307, there may be a plurality of such sensors at each of those locations. The sensors 301, 303 scan in a plane preferably orthogonally to the direction of retreat 113. In some instances the plane of scan may be slightly skewed relative to an orthogonal plane without affecting the process for determining gateroad structural change.

FIG. 3 shows a further scanning sensor 309 mounted to the gateroad traversing structure 109. This particular sensor 309 is used as a distance of travel determining sensor. The use of a scanning sensor 309 to determine distance of travel of objects as such robots or the like is well documented in many texts such as, for example, S Thrun. Robotic Mapping: A Survey. In G. Lakemeyer and B. Nebel, editors, Exploring Artificial Intelligence in the New Millenium. Morgan Kaufman 2002. Thus, in this embodiment, distance of travel measurement using a scanning sensor is utilised. Typically, the sensor 309 may be a 2D laser range sensor but may be a 3D laser range sensor or other suitable sensor. Further, any of the aforementioned type of sensors for the profile scanning may be utilised. In the embodiment of FIG. 3, the sensor 309 is mounted at a leading position on the gateroad traversing structure 109. This is a convenient position but is not limiting as to the location of the sensor 309 on the gateroad traversing structure 109.

The sensor 309 is arranged to scan forwardly into the gateroad 107 as shown by the dotted scan area 311, however, it could scan backwardly without affecting the performance of 301, 303 for detecting gateroad structural change. The scanning observes particular profile features and through appropriate processing of scan signals calculates a distance of movement. The process of calculating this distance does not itself form part of the basic inventive concept herein.

Accordingly, during a mining operation, the leading profile scanning sensor 301 scans surfaces of the gateroad 107. At a later point in time when the gateroad traversing structure 109 has travelled along the gateroad 107 a distance equal to distance "d", then the trailing profile scanning sensor 303 will be at the same position where a previous scan was made by the leading profile scanning sensor 301. Thus, the scans made by both sensors at that position can be utilised to note any structural change in the gateroad during the mining operation. Information from the scanning of the distance determining sensor 309 is used to determine the distance of travel, thereby permitting registration of the scans from the leading profile scanning sensor 301 with the scans from the trailing profile scanning sensor 303 at the same position.

Whilst a sensor 309 has been shown on the gateroad traversing structure 109 to determine retreat distance or travel distance of the gateroad traversing structure 109, other forms of determining distance of travel of the gateroad traversing structure 109 may be utilised. For example, a simple linear measuring device such as a tape may be utilised to determine the distance of movement in the retreat direction. The measured distance can then be used to register the two scans. Alternatively, proximity sensing activators may be placed at discreet positions along the gateroad 107. A sensor can be carried by the gateroad traversing structure 109 which operates when in proximity to those activators to trigger signals to indicate specific distance of travel.

Figure 4:
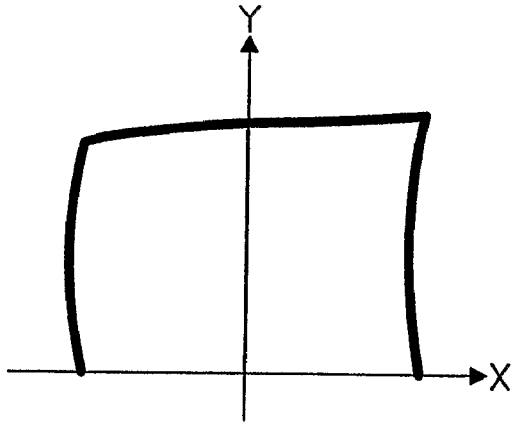
FIG. 4 is a typical cross sectional profile of a gateroad as scanned by a profile sensor in Cartesian coordinates.

FIG. 4 shows a typical scanned profile obtained from one of the gateroad profile scanning sensors 301, 303. It is assumed that the sensors 301, 303 have a sufficiently high resolution, scanning domain, and scanning rate to provide useful data of the profile of the gateroad surfaces.

In measuring the gateroad change, the system described here only requires that the gateroad structure is generally stable during the period of movement of the gateroad traversing structure 109. This requirement is generally readily met as the rate of gateroad change is very much smaller than the time interval of profile measurement. In a mining operation, the gateroad traversing structure 109 is moved for short periods over short distances with long stationary intervals in between. For example, the gateroad traversing structure 109 may move one meter in five seconds in the direction of retreat 113. It may be several hours later before the gateroad traversing structure 109 is again moved forwardly in the direction of retreat 113. Gateroad convergence rates are typically at a slow rate. For example, a convergence of 50 mm over a one week period near active workings may nominally constitute an acceptably stable gateroad 107. However, if there is a more rapid convergence, then this may indicate the likelihood of an unstable and dangerous situation. This embodiment includes a processing threshold that can be based on pre-established permitted safe profile information for a mine. Thus, if the scans obtained from the leading profile scanning sensor 301 and the trailing profile scanning sensor 303 differ by an amount greater than the threshold then an output warning can be provided.

Figure 5:
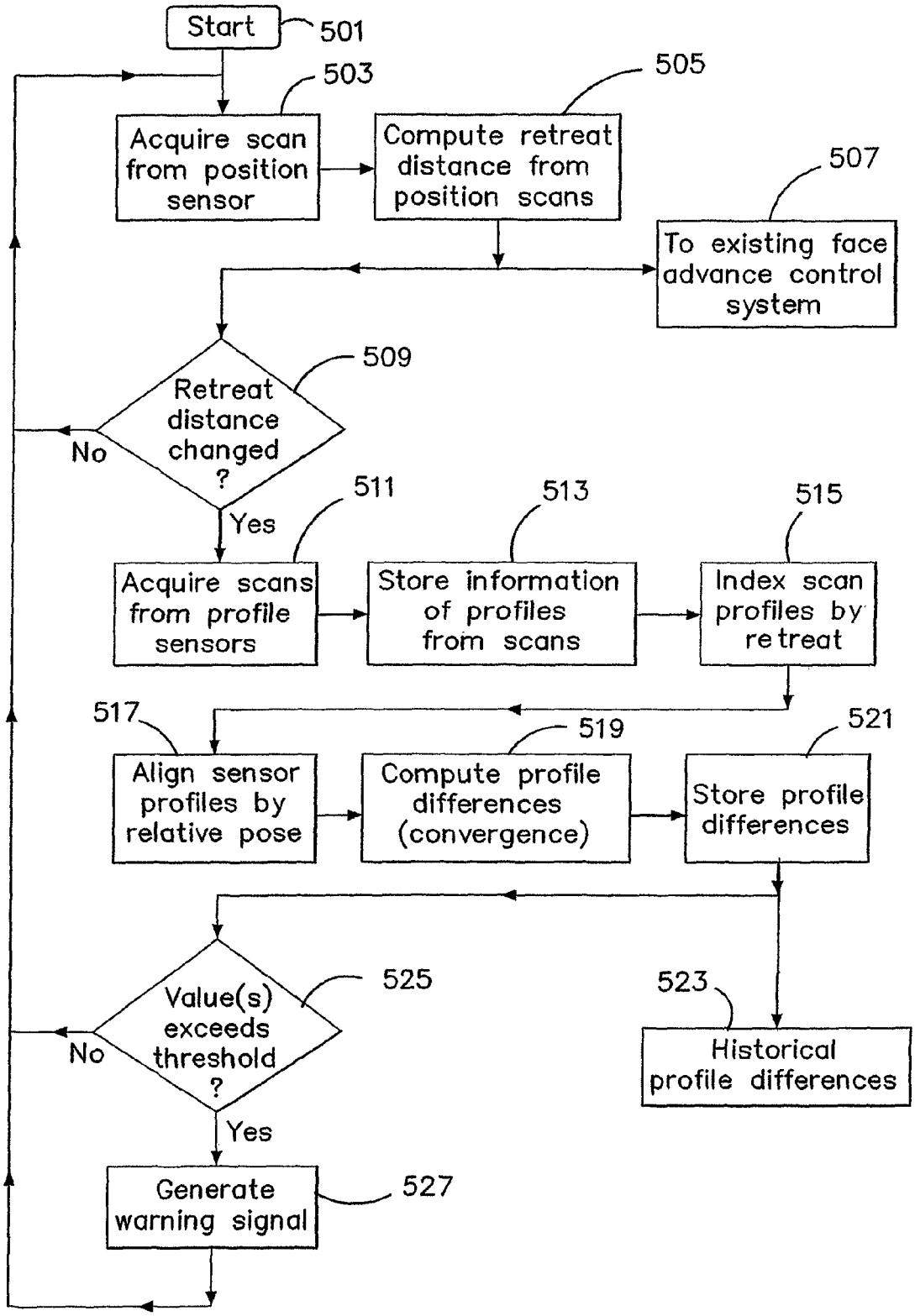
FIG. 5 is a functional flow diagram showing method steps in one embodiment of the invention.

Referring now to FIG. 5 there is shown a functional flow diagram of the various process steps used for determining gateroad structural change in this embodiment. The process starts at block 501. At step 503 a scan is obtained from position sensor 309 and provided to step 505 where a retreat distance is determined. A retreat distance signal is then provided to the mining machine control system through step 507. The distance of retreat is also processed at a decision making component 509 to determine if there has been a change in the retreat distance. If the answer is "NO" the process returns to step 503. If the answer is "YES", then scans are obtained from the profile sensors 301, 303 and stored in memory at step 513. At step 515, the acquired scans from sensors 301, 303 are registered together so that the scans from scanning sensor 303 correspond to the position of the scans obtained from sensor 301 at the same position along the gateroad 107. In other words, when sensor 303 has been displaced along the direction of retreat 113 a distance 'd' to a point where it coincides to where a scan has previously been made from sensor 301, then there is registration. At step 517, the sensor scans are aligned to compensate for any change (due to creep or other factors that may have occurred) to the relative pose of the gateroad traversing structure 109 during its passage along the distance "d". This aspect will be explained further in due course.

The two scanning profiles, being a profile from sensor 301 and from sensor 303, are then passed to step 519 where the profile signals are subtracted from one another to note for any change. The result of this subtraction represents a measure of convergence. Whilst the signals have been indicated as being subtracted from one another, other forms of computation of change can be implemented. For example, the time taken for the trailing sensor 303 to traverse the distance "d" can be noted along with the differential change in the profile. This, in turn, can represent a time rate of change and can be used to predict collapse of the gateroad 107 or surrounding strata. Any differences or convergence can be passed to a historical store at step 523 so the results can be referenced at a later time. Any difference (convergence) is then passed to a decision process 525 to determine if the difference (or rate of difference) exceeds a predetermined threshold. This threshold can be chosen with regard to known or expected safe profile information difference changes for a particular mine. If the decision process determines that the threshold has not been exceeded then the process returns to step 503. If the decision process determines that the threshold has been exceeded then a warning signal can be provided at step 527. Concurrently, the process can return to step 503.

It should be appreciated that at step 519, any differences may be displayed on a monitor screen so that an operator may immediately observe the monitor screen and determine by visual inspection of the monitor screen the convergence. Thus, that person may then subjectively take action based on the observation.

Figure 6:
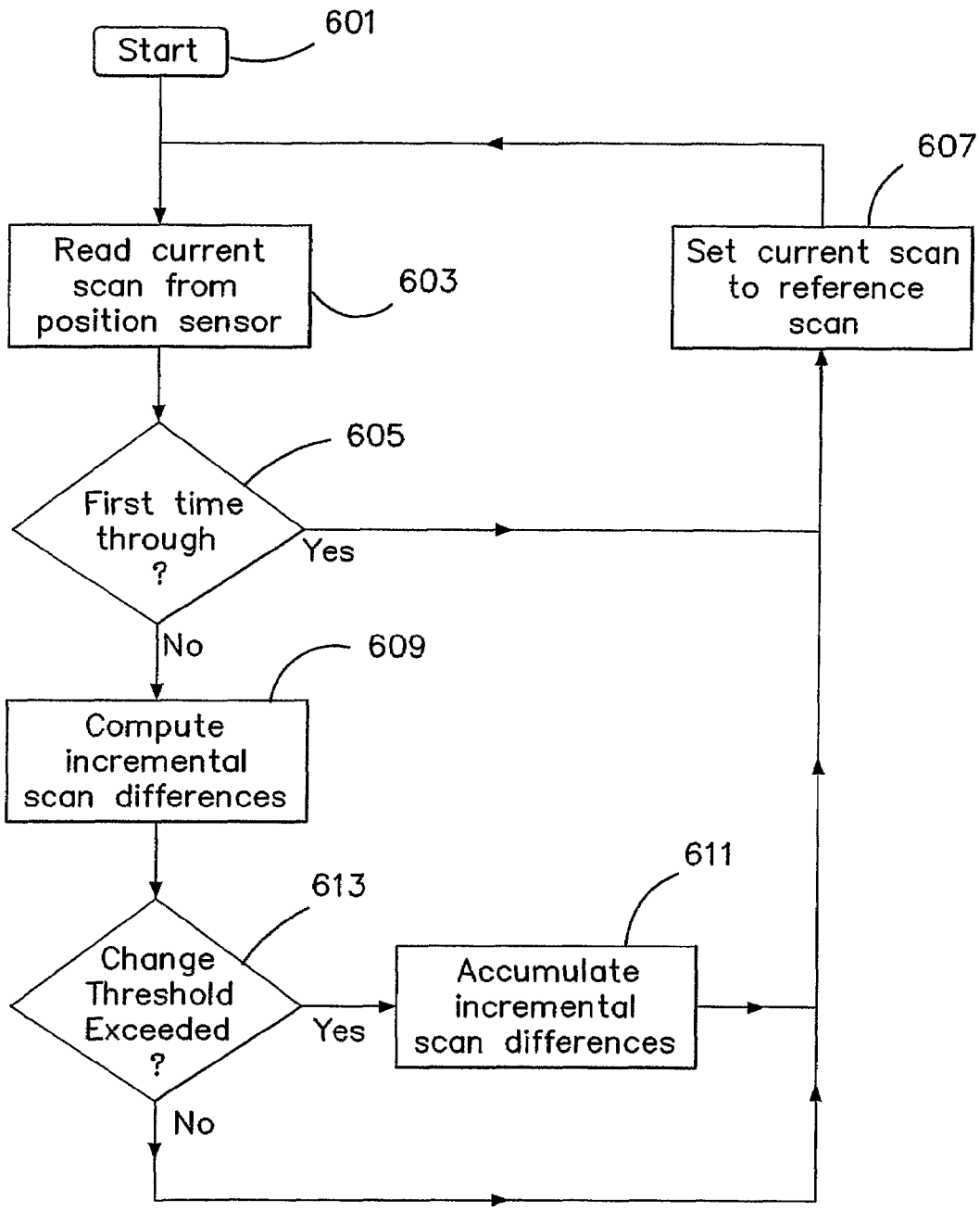
FIG. 6 is a functional flow diagram showing method steps for determination of retreat distance.

Referring now to FIG. 6, there is shown a functional flow diagram of process steps involved in determining a retreat distance of movement along the retreat direction 113. Here, a 2D or 3D range sensor such as a 2D laser-based range sensor is mounted to the gateroad traversing structure 109. This sensor is identified in FIG. 3 as sensor 309. However, it may include utilising the sensor 301 for position location (as well as using the sensor 301 for the profile scan). The sensor 309 provides distance measurements from the sensor itself to the gateroad surfaces. Typically, it has a scan that occurs over a 180° scanning domain. A useful acquisition rate is 25-30 scans per second. As indicated previously, any type of sensor may be utilised and the particular sensor is not specific for this implementation. Any known methods for determining (incremental) motion and distance of travel of a platform using a sensor can be used. These can employ a form of reference-to-current scan comparison based on the following:

A change in the position and/or orientation of the sensor corresponds to a translation and/or rotation change in a range scanned. Incremental motion can be deduced by computing a specific translation and/or any rotation components required to make a previously acquired scan match the current scan.

Current position and/or orientation at a given time are subsequently deduced by accumulating the incremental translation and rotation components.

FIG. 6 shows four sub-steps used in a determination of the position of the gateroad traversing structure 109 using a laser based measurement approach. Here, the system commences at step 601. At step 603 the current scan from the position sensor 305 is read. At step 605, a decision is made as to whether the scan has already been made, i.e. "Is it the first time through?" If the answer is "YES", the system sets the current scan to be a reference scan at step 607 and returns to read the next scan from the position sensor at 603. If the answer is "NO", then the system proceeds to step 609 to compute incremental scan differences. Here, the system computes translation and/or rotation differences (if any) between the current scan and the reference scan to measure any incremental change in position and/or orientation of the gateroad traversing structure 109 that may have occurred between adjacent position sensor scans. Many known methods exist to address this process. The most common of these are scan correlation and the iterative closest point (ICP) algorithm. Another approach, known as simultaneous localisation and mapping (SLAM), can be useful if the position sensor signals from scans are noisy. The exact process is not critical to the inventive concept.

The scan correlation based approach is most useful when the dominant component of movement is in the direction of retreat 113. Because of the large size and mass of the gateroad traversing structure 109 it can be assumed that this movement will be primarily in the direction of retreat 113. Creep and orientation also vary, but typically vary only to a small degree in comparison to the movement in the direction of retreat 113. In the correlation based approach, pure translational change between the reference scan and a current scan is obtained in a single standard correlation step. Because the sensor 309 is obtaining information in the form of data in Cartesian coordinates, any displacement changes observed in the correlation of the reference scan to the current scan can be directly linked to an incremental change in the position of the gateroad traversing structure 109. The correlation based approach is useful where the position sensor 309 is mounted to provide a parallel scanning domain with respect to the direction of retreat 113.

If an iterative closest point approach is used, an ICP algorithm determines the retreat and creep of the gateroad traversing structure 109. ICP is a general iterative alignment algorithm that works by estimating the rigid rotation and translation that best maps the first scan onto the second, and applying that transformation to the first scan. The process is then reapplied iteratively until ICP convergence is achieved. The incremental translation and rotation changes are obtained following ICP convergence and they can be directly associated with incremental changes in the position of the gateroad traversing structure 109. The ICP algorithm is recommended where the position sensor is mounted to provide a transverse scanning domain with respect to the direction of retreat 113.

The accuracy of retreat measurement can be improved by providing an option to ignore very small incremental changes in retreat scans arising from gateroad convergence.

The incremental scan differences generated at step 609 are first compared to a pre-determined minimum position change threshold at step 613, based on the expected motion of the traversing structure 109 and the convergence rate.

If the incremental scan difference computed at step 609 exceeds the pre-determined incremental change threshold, then it is taken that the traversing structure 109 is undergoing motion and processing proceeds to step 611; otherwise the system proceeds to step 607 and returns to read the sensor at step 603.

The incremental change comparison step 613 may be useful where the gateroad traversing structure 109 remains stationary for long periods of time in the presence of significant gateroad convergence. If no particular information is known regarding convergence or gateroad traversing structure dynamics, then the threshold in step 613 can be simply set to zero and incremental differences generated in step 609 will be processed in step 611.

At step 611 the accumulative incremental scan differences are determined by summing the incremental translation components as computed in step 609. Rotational components can be similarly obtained if necessary. The retreat distant measurement is subsequently used to index and register the scan signal information from the leading and trailing sensor profiles for computation of gateroad convergence.

In some rare cases where a laser-based position sensor approach is not suitable, an independent position measurement can be obtained in other ways. One way is to use a high accuracy inertial navigation system, or another system such as a proximity sensor system as previously discussed.

It should be noted that the step 517 of FIG. 5 requires that there is alignment of leading and trailing sensor scan profiles by relative pose. The convergence calculation is based on the premise that the scanning profile sensor information signals are observed from the same spatial location at different time instances. Thus, it is assumed that the relative path and poses of the leading and trailing profile sensor paths are coincident. It is therefore assumed, but it is not essential, that the path of the trailing sensor 303 closely follows the path and pose of the leading sensor 301. For a longwall operation this is usually the case due to the relatively small spatial separation between the two sensors 301, 303 (typically 5-30 meters), as well as the highly constrained and slowly moving dynamics of the gateroad traversing structure 109. In this case, which is an ideal case, it can be assumed that no alignment of the profile signals obtained from the leading sensor and trailing sensors 301, 303, is required. However, in some cases the signals obtained from the profile sensors may exhibit small variations in relative positions and orientation/pose over a distance of travel of the gateroad traversing structure 109 by separation distance "d". Thus, the sensors 301, 303 will observe the gateroad surface from a different view point. The small variations can be readily compensated for (if necessary) in one of the following ways.

1. Exploiting Naturally Stationary Geological Structures

Figure 7:
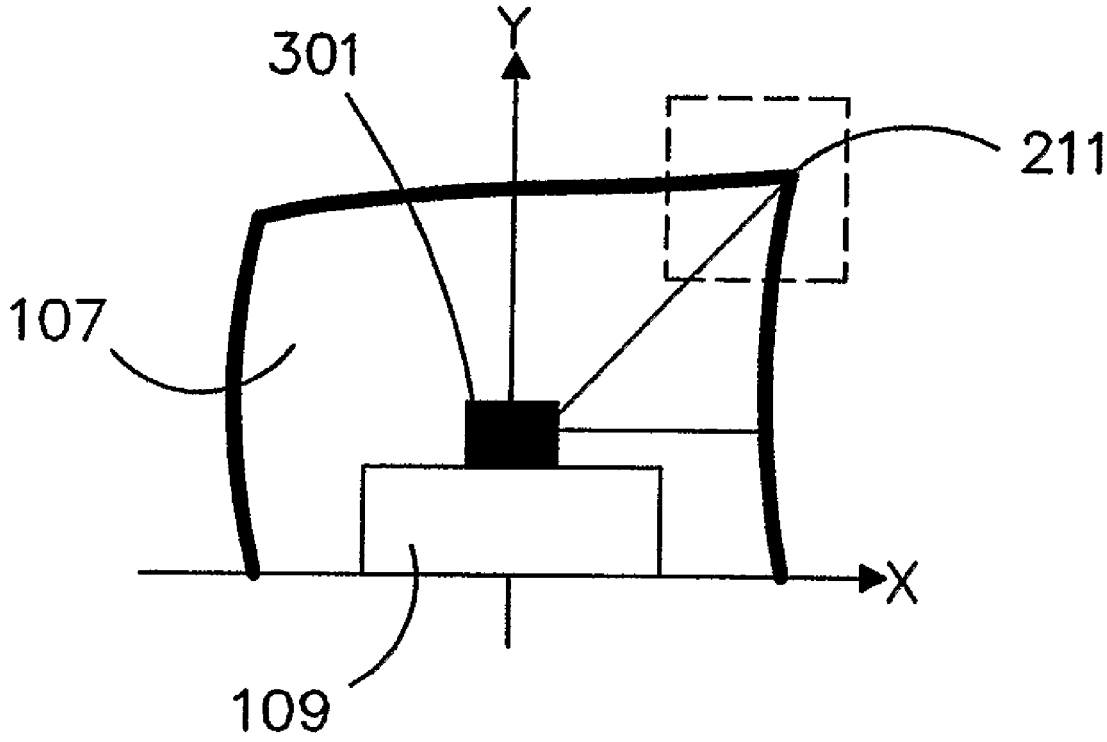
FIG. 7 is a vertical cross sectional view of a gateroad showing a gateroad traversing structure.

It has been observed that the top upper corner 211 (see FIG. 2) of the gateroad 107 is geologically stable and can maintain structural integrity for long periods: often over many months. This corner 211 is readily visible in the gateroad profile sensor scan information and can be used as a landmark for individual profile sensor pose estimation. Such a technique is useful in the case where small variation in sensor pose is apparent. FIG. 7 shows the configuration.

The position and orientation of the uppermost corner 211 can be obtained through a standard application of the ICP algorithm (as referred to previously) at the corner of interest for both the leading and trailing profile sensor scans. The required profile pose compensation can then be obtained by direct application of the computed translation and rotation values associated with the leading and trailing sensor scans at a particular retreat distance of interest. This pose information will then be applied to transform the trailing sensor profile scan into the same sensor coordinate system as that obtained from the leading sensor 301. Because convergence relates to differences in gateroad distance profile, i.e. relative, and not absolute profile differences, it is sufficient to compute the difference in profile poses to determine convergence.

2. Independent Pose Measurement

In this case, where the previous method provides unsuitable, it is possible to employ the use of high accuracy inertial navigation units to either augment or provide an independent measure of the leading and trailing sensor poses. An analogous compensation method as mentioned above is similarly applied to the trailing sensor 303 where the amount of translation and rotation applied to the trailing sensor profile information is given by the difference in leading-to-trailing sensor pose.

At step 519 of FIG. 5 the profile differences are computed. Here, convergence is determined by calculating the algebraic difference over all overlapping gateroad surface range profile scans. In other words, the leading and trailing profile scans from the respective sensors 301, 303 that have the same position. Unlike traditional single-point convergence measurement methods, this approach computes convergence over entire surfaces, providing a vast improvement in the quality and quantity of information for gateroad profile assessment. An advantage in using a laser sensor is that the convergence calculation represents an actual displacement in the gateroad 107.

In an ideal case where structural integrity is maintained in the gateroad, the convergence will be zero. In general however, deformation will occur and thus the convergence will be non-zero.

Other forms of providing gateroad structural change can be utilised where, for example, absolute differences and image correlation can be utilised. In the preferred example a subtraction process is utilised to note the differences in signals of information from the leading sensor 301 and the trailing sensor 303.

At step 525 of FIG. 5 the gateroad integrity and/or an assessment of the gateroad structural change can be monitored by ascertaining that the difference values or rate have exceeded a predetermined threshold value. Such a threshold can be applied to a particular mine having regard to known past threshold levels where stability can be expected and/or where stability is likely to be breached.

It should be appreciated that by using a scanning sensor to determine the distance movement i.e. retreat distance, that an accurate measure of that distance can be obtained. Further, and as indicated in FIG. 5 at step 507, the distance of travel measurement can be output to the existing mining machine control system to control the movement of the mining machine itself.

Figure 8:
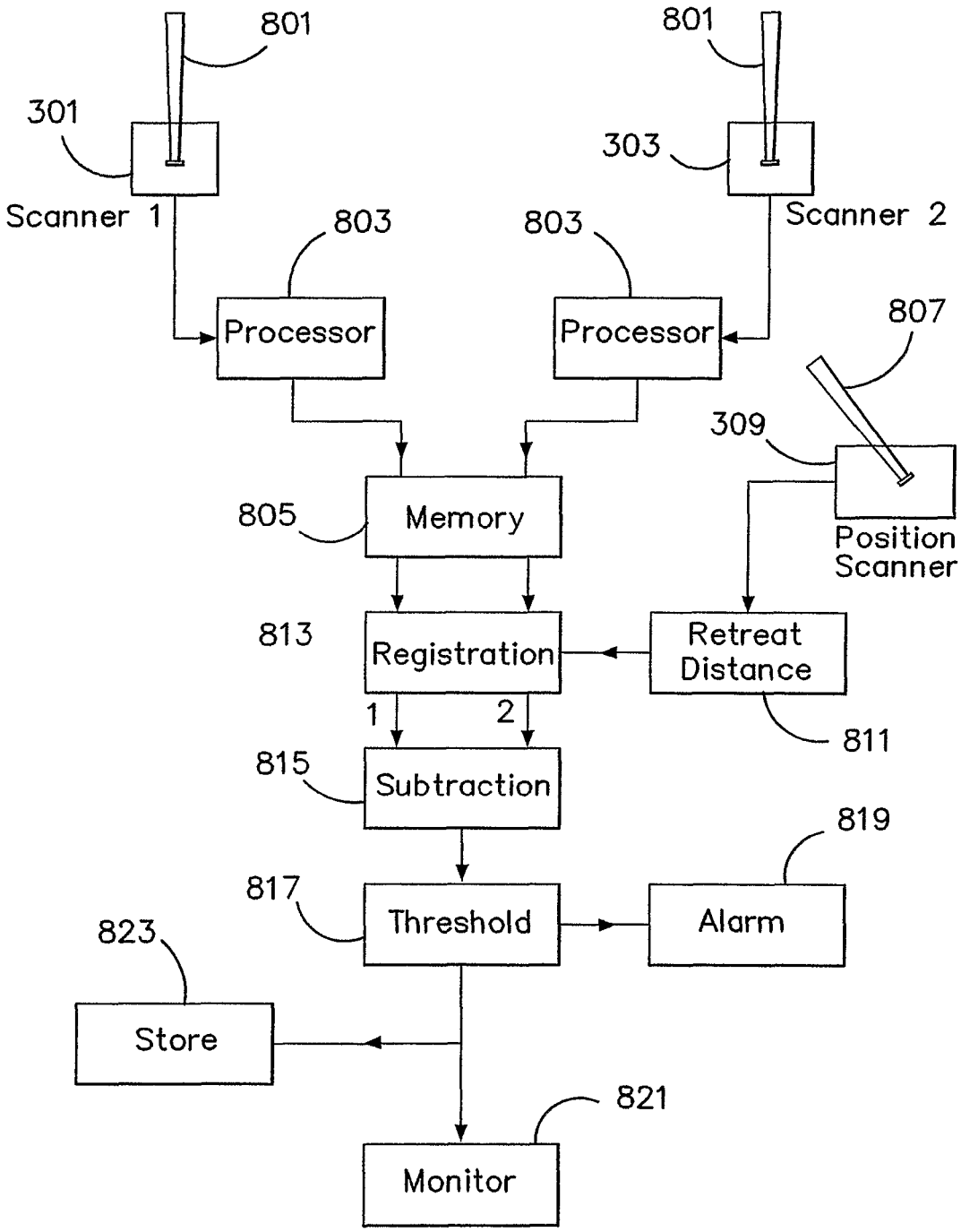
FIG. 8 is a block schematic diagram of physical hardware components for determining gateroad structural change.

Referring now to FIG. 8 there is shown a block circuit diagram of the example of the preferred embodiment. It should be appreciated that most of the functional process steps are implemented within a computer controlled system by the functionality of purpose developed software. FIG. 8 shows the leading scanning profile sensor 301 and the trailing profile scanning sensor 303. Each of these sensors has a plane of scanning of a laser beam as shown by 801. This plane is generally taken over a 180° scanning arc and the plane is generally orthogonal to the direction of retreat 113. Output information signals are provided to processors 803 where the output information signals are suitably processed to remove noise and other unwanted signal components. The output signals are then provided into a memory device 805. A position scanning sensor 309 has a scan 807 which is directed forwardly of the gateroad traversing structure 109 in the direction of retreat 113. Typically, this scanner is a laser scanner and the plane of scan is forwardly inclined. The output information signals are processed through a processing circuit (not shown) to remove noise and other unwanted signal information. The signals are then forwarded to retreat distance processor 811. A retreat distance is then calculated by the retreat distance calculator 811 and provided into a registration circuit 813. Here, information signals representing the scans from the leading sensor 301 and the trailing sensor 303 are brought into registration at the same particular scanning position in the gateroad 107. The two signals are then passed through a subtraction circuit 815 where the differences between the two information scan signals are determined. Any difference signals are then passed to a threshold circuit 817 where the difference signals are checked to see if they exceed the range or rate threshold set in the threshold circuit 817. If the difference signals exceed the threshold then an output can be provided to raise an alarm 819. The results of the subtraction circuit 815 are also passed through the threshold circuit directly to a monitor circuit 821 such as a monitor screen so the observing person can physically monitor the difference signals. Simultaneously, the signals can be forwarded to a store 823 for historical recording.

Modifications may be made to the embodiments described above as would be apparent to persons skilled in the art of controlling mining machine operations. For example, it is of course possible to monitor convergence at a particular distance of retreat from only one of the profile scanning sensors. In this instance, if the gateroad traversing structure 109 has not moved a distance in the gateroad 107, then a first profile scan can be obtained from either the leading or trailing sensor, and then at a later time, a second profile scan can be obtained from the same sensor. In this case, the first profile scan information would be stored, and registered with information from the second profile scan to note any differences. The difference signals would then be processed in the same way as in the previously described embodiment with regard to determining if the difference exceeds a predetermined range or rate threshold difference. In this way, any convergence can be determined even if the profile scanning sensors do not move a distance along the direction of retreat 113. The associated software processing steps can be appropriately readjusted to provide this processing of the profile scan information.

In a variation of the above, a single scanning sensor can be used to obtain profile scans at different time instants at the same position in the gateroad. The resulting scan information can be registered and any convergence determined.

These and other modifications may be made without departing from the ambit of the invention, the nature of which is to be determined from the foregoing description and the following claims.

The invention claimed is:

1. A method of determining gateroad structural change in a mining operation comprising:

using a gateroad profile scanning sensor at a position of a gateroad to scan generally orthogonally to a direction of the gateroad and obtaining a first profile scan of surfaces of the gateroad and storing information of the first profile scan in a memory;

at a later time obtaining information of a second profile scan with the same or a different scanning sensor of surfaces of the gateroad generally orthogonal to the direction of the gateroad at a position in the gateroad that generally coincides with the position where the first profile scan was made; and processing the information of the first profile scan and the second profile scan to determine any structural change of the surfaces of the gateroad corresponding to deformation in profile of the gateroad.

2. The method as claimed in claim 1 wherein the gateroad scanning sensor is mounted to a gateroad traversing structure of a mining machine installation, and the first profile scan is obtained from a leading position of the gateroad traversing structure and the second profile scan is obtained from a trailing position of the gateroad traversing structure at a time when the trailing position generally coincides with the position in the gateroad where the first profile scan was made.

3. The method as claimed in claim 2 comprising using a leading position gateroad scanning sensor for the first profile scan at the leading position, and a second trailing position gateroad scanning sensor for the second profile scan at the trailing position.

4. The method as claimed in claim 3 comprising storing information concerning the distance of spacing between the position on the gateroad traversing structure where the first profile scan is made and the position where the second profile scan is made so that when the distance of movement of the gateroad traversing structure generally corresponds to the distance of spacing apart there can be overlapping scans and registration of the stored information of the first profile scan and the second profile scan.

5. The method as claimed in claim 3 comprising mounting a distance sensor to the gateroad traversing structure to determine a distance of travel so that when the distance of travel corresponds to the distance of spacing between the leading sensor and the trailing sensor and there is general overlapping of scans, the information of the second profile scan can then be obtained.

6. The method as claimed in claim 5 wherein the distance sensor comprises a 2D or 3D scanning range sensor and wherein a distance of retreat is determined as the distance of travel.

7. The method as claimed in claim 6, wherein the distance sensor is caused to scan in a direction looking forward into the direction of retreat of the gateroad traversing structure.

8. The method as claimed in claim 7, wherein retreat distance is determined by processing information from a profile scanning sensor using a correlation or geometric method.

9. The method as claimed in claim 2 comprising compensating the information of the leading position scan or the information of the trailing position scan for any variation that may occur in the information as a result of a change in a path or pose of the gateroad traversing structure as it travels along the gateroad.

10. The method as claimed in claim 2 wherein the leading position scan sensor and the trailing position scan sensor are 2D or 3D scanning range sensors.

11. The method as claimed in claim 1 comprising comparing the information from the first profile scan with the second profile scan to obtain overlapping scan profiles to note differences corresponding to deformation in profile of the gateroad.

12. The method as claimed in claim 11 wherein any differences noted are compared against a predetermined range or rate threshold difference, and providing an output if the threshold is exceeded.

13. The method as claimed in claim 12 where the output provided is a warning output.

14. The method as claimed in claim 12, wherein the predetermined threshold difference is based on pre-established permitted safe profile information difference changes for a mine.

15. The method as claimed in claim 1 wherein the scanning sensor comprises a 2D or 3D scanning range sensor.

16. The method as claimed in claim 1 wherein the scanning sensor comprises a subsurface radar scanning sensor.

17. The method as claimed in claim 1 wherein the scanning sensor comprises a laser and/or radar scanning sensor.

18. The method as claimed in claim 17 wherein the radar scanning sensor comprises a subsurface radar scanning sensor.

19. The method as claimed in claim 1 wherein the deformation in profile of the gateroad comprises convergence of the gateroad.

* * * * *